United States Patent [19]

Kruger

[11] 4,363,428

[45] Dec. 14, 1982

[54] BULK BIN FEED DELIVERY APPARATUS

[75] Inventor: Joseph A. Kruger, Warsaw, Ind.

[73] Assignee: Brock Manufacturing, Inc., Milford, Ind.

[21] Appl. No.: 184,131

[22] Filed: Sep. 4, 1980

[51] Int. Cl.[3] ..... B65G 65/48

[52] U.S. Cl. ..... 222/227; 222/236

[58] Field of Search ..... 222/227, 228, 236, 242; 414/305, 306, 310–312; 366/317, 287, 279, 325

[56] References Cited

U.S. PATENT DOCUMENTS

| | | | |
|---|---|---|---|
| 3,067,914 | 11/1962 | Ellaby | 222/236 |
| 3,223,290 | 12/1965 | Schuld | 222/228 |
| 3,339,759 | 9/1967 | Wellons | 222/236 |
| 3,508,670 | 4/1970 | Schuld | 414/305 |
| 4,034,898 | 7/1977 | Marttila et al. | 222/228 |
| 4,066,164 | 1/1978 | Easton | 414/306 |
| 4,146,145 | 3/1979 | Easton | 414/310 |
| 4,167,248 | 9/1979 | Akazawa et al. | 222/242 |

FOREIGN PATENT DOCUMENTS

| | | | |
|---|---|---|---|
| 912587 | 12/1962 | United Kingdom | 222/242 |

OTHER PUBLICATIONS

Brochure copy, Schuld Bulk Feed Bins.

Brochure copy, Schuld Full Flow Bin Unloader.

*Primary Examiner*—Stanley H. Tollberg

*Attorney, Agent, or Firm*—Trexler, Bushnell & Wolters, Ltd.

[57] ABSTRACT

When poultry or other livestock feed is stored within a bin having a conical bottom, the feed can become packed and bridge across the bin bottom opening. Under such circumstances, delivery of feed to an underlying conveyor may be erratic under some conditions. To overcome this, the present invention provides a first rotatable shaft extending upwardly along the axis of the bin bottom cone. A second shaft is joined to the first shaft by a universal joint. Mounted on the second shaft are a number of poly-sided discs. Here, these discs are equilateral triangles, and the triangle corners or points are bent out of the plane of the mediate disc portions. Arrangements are provided for locking the discs to the second shaft. If desired, a feed support disc can be carried by the first shaft below the second shaft so as to at least temporarily support feed which has been dislodged by the rotating poly-sided discs above it. If desired, a shaft extension can be provided below the first shaft, and agitator means can be mounted to the shaft extension to inhibit re-packing of feed which has been dislodged and has fallen below the first shaft.

22 Claims, 7 Drawing Figures

11
13
14
16
17
2.
10
12
24
39
61
60
38
31
30
32
77
70
74
35
3
A
42
33
18
20
25
23
21
80
82
81

BULK BIN FEED DELIVERY APPARATUS

BACKGROUND OF THE INVENTION

This invention relates generally to delivery devices for particulate mixes such as poultry feed and the like, and more particularly concerns apparatus for positively creating a uniform, steady flow of material from a storage bin to a conveyor.

Modern poultry or livestock feeding operations deliver precise amounts of particulate feed mixes to consuming poultry from large, remotely located storage bins. Conventionally, a feed conveyor is located under such a bin to carry the needed feed to the poultry. When a large quantity of feed is stored in a storage bin, the feed can become packed and stick or bridge across a bin delivery or exhaust opening. When this happens, little or no feed is delivered to the underlying conveyor and downstream apparatus.

To overcome this problem, a number of positively acting bin unloading mechanisms have been proposed. Two such proposals are found in U.S. Pat. Nos. 3,223,290 and 3,508,670, but apparently the devices suggested there have not met with universal commercial acceptance.

It is an object of this invention to provide a low cost, positively-acting device which will encourage a positive flow of feed from a storage bin to an underlying feed conveyor even when feed is packed within the bin. A related object is to provide a commercially attractive, positively acting bin unloader which will deliver feed to the underlying conveyor even when the feed has been subjected to extreme packing and bridging conditions.

Another object is to provide feed delivery-insuring apparatus which encourages feed flow and movement along the bin sides, so as to polish the bin sides and discourage feed bridging action within the bin to the maximum extent possible. A related object is to provide apparatus which will encourage this feed flow along the bin sides so as to encourage the movement and dispensation of bin feed located along those bin sides, thereby eliminating or discouraging the stagnation of feed located adjacent the bin sides and the consequent possibility of feed spoilage within the bin.

Yet another object is to provide feed delivery-insuring apparatus which positively engages or attacks packed feed, positively dislodges it, and positively discourages subsequent re-packing or re-bridging as the feed moves toward the conveyor.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figures 1, 2, 3:
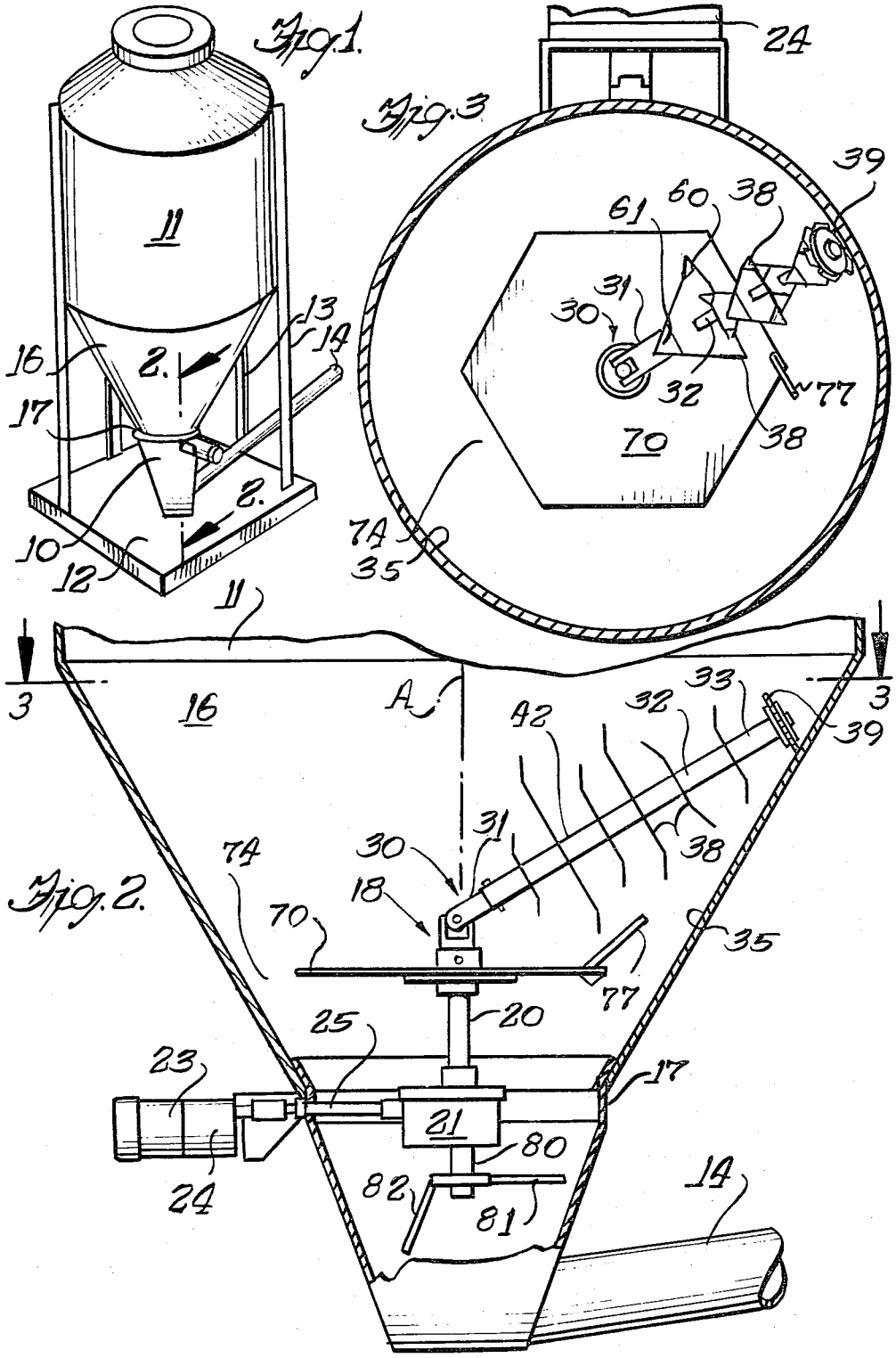
FIG. 1 is a perspective view showing a bin for containing a store of feed and an associated feed delivery conveyor, the bin support legs being rearranged slightly for clarity.
FIG. 2 is a fragmentary sectional view taken substantially in the plane of line 2—2 in FIG. 1.
FIG. 3 is a sectional view taken substantially in the plane of line 3—3 in FIG. 2, portions of the novel apparatus being rearranged slightly for clarity.

Turning first to FIG. 1, there is shown an embodiment of a novel delivery and metering apparatus 10 as it appears when installed for use with a bulk feed storage bin 11 designed to hold poultry feed or like particulate material. The bin 11 is supported upon a foundation pad 12 by support legs 13. Feed or other material (not shown) is conducted from the bin 11 and through the delivery apparatus 10 to a conveyor 14 which can be of the auger type. The bin 11 is defined in its lower portion by a cone 16 which terminates at an annular planar exhaust port. As feed is carried away by the conveyor 14, additional feed works its way down the bin and cone 16 and through the exhaust port collar 17.

If a great weight of feed is stored within the bin, or if the feed is moist, or if other conditions are present, the feed can become packed within the bin and "hand up" or bridge across portions of the cone 16 or exhaust collar 17. This bridging can prevent proper delivery of feed to the underlying conveyor 14. Should portions of this packed feed suddenly come loose and drop through empty portions of the cone 16 and collar 17, the impact of this feed upon the conveyor 14 and other system parts can cause unnecessary wear and possible damage to the parts. The sudden dislodgement and fall of feed clumps into the conveyor 14 also can cause a non-uniform flow of feed to downstream parts of the feed system.

In accordance with the invention, therefore, apparatus 18 is provided for positively delivering a steady or uniform-rate flow of feed through the cone 16 and collar 17 to the conveyor 14. Here, a first rotatable shaft 20 is vertically mounted so as to extend from the region of the collar 17 upwardly into the cone 16. Appropriate support structure 21 (here, a gearbox drive and appropriate mounting struts) locates this first shaft 20 in a position substantially coincident with the axis A of the cone 16 itself. The shaft 20 can be driven by an electric motor 23 or other prime mover through a gear drive 24 and extension shaft 25, or by other suitable means.

The upwardly extending shaft 20 terminates in a universal joint 30. A second shaft assembly 32 is secured to a portion 31 of the universal joint 30, and the shaft assembly 32 extends to a distal end 33 adjacent the wall 35 of the cone 16. A number of polysided discs 38 of various sizes are secured at spaced apart locations along the shaft assembly 32. The distal shaft end 33 mounts a non-abrasive saw-tooth-edged disc 39 which normally rests against the cone wall 35.

When the motor 23 is energized, and the shaft 20 is rotated, the universal joint 30 will be rotated. Due to internal friction within the universal joint 30, it is contemplated that the shaft assembly 32 will be rotated through a sweeping motion which is generally angularly coextensive with the shaft 20 when the auger is not surrounded by feed. When, however, feed is encountered and a consequent resistance to this sweeping motion is experienced by the shaft assembly 32, this equiangular motion of the shafts 20 and 32 will cease, and the shaft assembly 32 will turn about its own axis. Thus, although the shaft 32 will undergo rotation coextensive with the rotation of the shaft 20, the shaft assembly 32 itself may no longer undergo angular displacement coextensive with the shaft 20. The sum of the angular displacement of the shaft assembly 32 about its own axis and about the shaft 20 axis A will, of course, equal the angular displacement of the shaft 20. The rotating, moving discs 38 and 39 will engage the packed feed constituting the impediment to shaft assembly 32 sweep motion, and will loosen and drop that packed feed down toward the exhaust 17. In this way, feed bridging will be eliminated.

As shown in FIGS. 4–7, the second shaft device 32 here comprises an assembly which effectively yet inexpensively holds the discs 38, 39 in place. In accordance with this aspect of the invention, the assembly 32 includes a hollow inner drive tube 40 having a non-circular cross-sectional configuration. Here, for convenience in manufacturing, the configuration is square, as shown especially in FIGS. 4 and 6. A single inner shaft member 41 extends from the universal joint portion 31 to the disc 39. Over this inner drive member 41 fit mating spacers 42 which serve to locate aand clamp the discs 38 in the desired locations along the shaft assembly. It is contemplated that the discs 38 will be provided with apertures 43 sized and shaped to closely mate with the inner drive shaft 41 as suggested in FIG. 5 so that no welding or other fastening arrangement necessarily need be provided to directly secure the discs 38 in place on the shaft assembly 32.

Figures 4, 5, 6, 7:
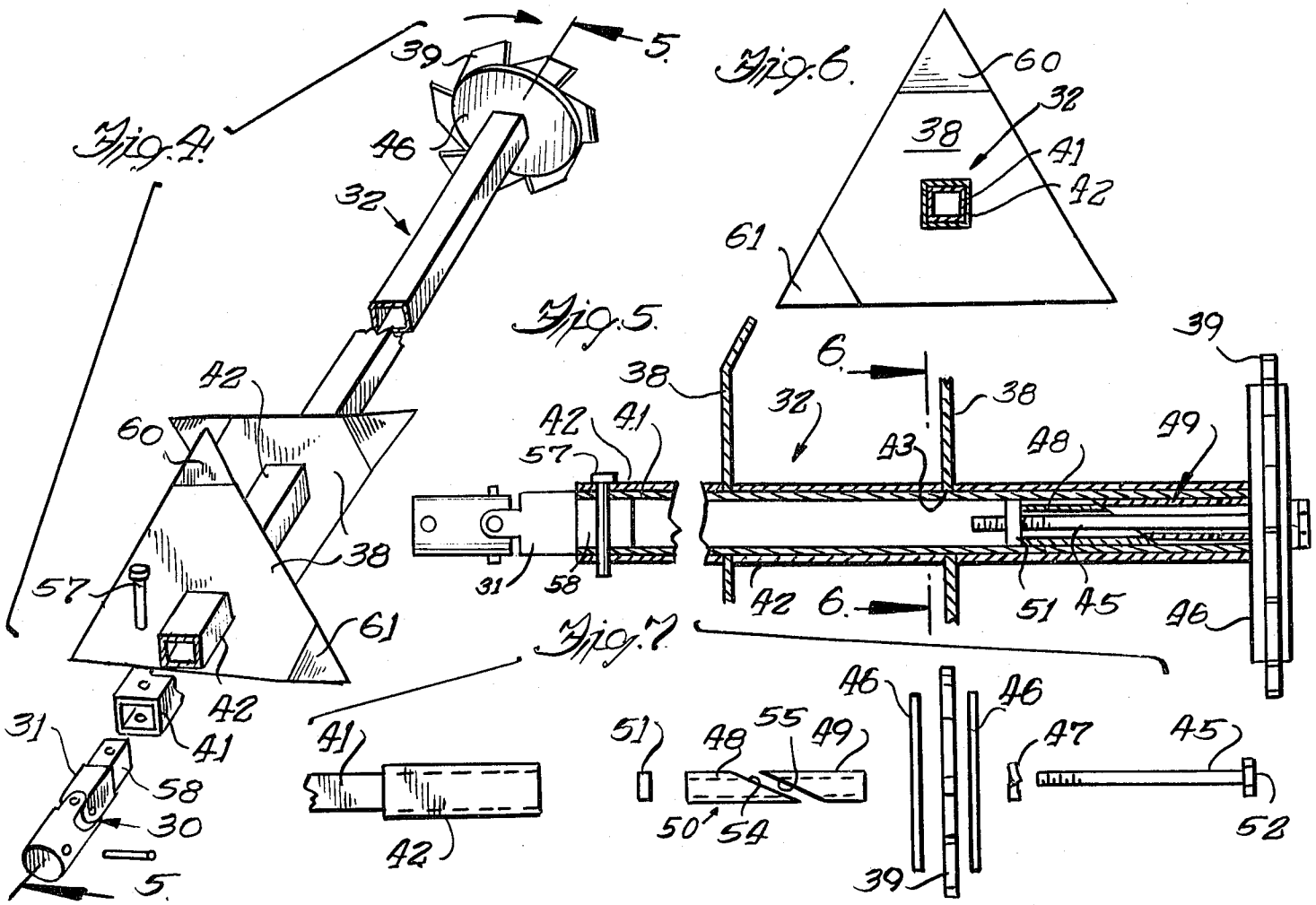
FIG. 4 is a fragmentary perspective of a shaft assembly and related parts.
FIG. 5 is an elevational or plan view of the structure shown in FIG. 4.
FIG. 6 is a sectional view taken substantially in the plane of line 6—6 in FIG. 5.
FIG. 7 is an exploded view of the structure shown in FIGS. 4 and 5.

The disc 39 can be mounted on the end of the shaft assembly without weldments, as indicated in FIGS. 5 and 7. The disc 39 is assembled on a conventional bolt 45 between two plates 46. A lock washer 47 may also be included to discourage disc/bolt movement. The bolt is inserted through two mating elements 48 and 49 of a square tubing locking device 50. The bolt is then turned into a square nut 51 which has an outer size and shape adapted for insertion into the hollow interior of the inner shaft member 41, but to inhibit nut/shaft relative rotation. When the bolt 45 is turned, the nut 51 engages the interior of the shaft member 41, and is thus prevented from rotation with the bolt 45. Further bolt rotation draws the nut toward the nut head 52 and disc 39, in known manner. This progressive squeezing action between the nut 51, discs 46, disc 39 and bolt head 52 axially forces together the locking device elements 48 and 49. As the elements 48 and 49 are urged together, they attempt to move past one another along the mating bevel surfaces 54, 55. This motion urges each element 48, 49 into frictional locking engagement with the interior of the inner shaft member 41, as indicated in FIG. 5. In this way, the end disc 39 is mounted securely to the shaft assembly 32, yet the disc 39 can be easily removed and replaced should disc 39 damage or excessive wear occur.

At its proximate end, the shaft assembly 32 is attached to the element 31 of the universal joint 30 by a pin 57. This pin 57 joins the square end 58 of the universal joint element 31, an outer shaft spacer element 42 and the inner square shaft member 41.

To increase feed penetration and dislodging action in accordance with the invention, the polysided discs 38 here assume the form of equilateral triangles, and have their corners 60, 61 bent at various angles. By so bending the tips or corners 60, 61, a greater volume or region of feed-containing space within the bin 16 will be swept and directly cleared of packed feed.

During normal operation, the polysided discs 38 engage the feed with a slicing, loosening action, causing the feed to fall downwardly through the bin. No feed propelling action need be provided. At the same time, this feed engagement acts to draw the shaft assembly 32 forward in its conical sweeping path around the bin. The non-circular shape (here, the square shape) of the shaft assembly 32 also engages the packed feed to some extent. This feed/shaft digging interengagement encourages feed dislodgement and shaft clearing motion. When feed or material is completely removed from a particular space along and above the hopper wall, the non-abrasive saw-tooth-edged distal disc 39 comes into contact with the hopper wall 16 and acts to drive itself, the shaft assembly 32 and the mediate discs 38 forward into more feed. Thus, the rotating discs 38 do not generate any stripped surface in the packed feed, and no inhibition to further feed slicing and loosening action is generated. To provide even feed engagement and slicing action in carrying out the invention, the discs 38 are angularly offset with respect to one another. The discs 38 can be made of various sizes to further encourage gradual, uniform feed engagement, and feed slicing and loosening action throughout a large region.

Below the shaft assembly 32 and discs 38, 39, the shaft 20 can carry a feed support member 70 which takes the form of a polygonal disc in accordance with another aspect of the invention. As shown in FIGS. 2 and 3, this disc 70 is defined by a hexagonal periphery 71 which is spaced apart from the bin exhaust sides 35 to define at least one annular aperture 74 through which a flow of dislodged feed can pass. In accordance with another aspect of the invention, the aperture 74 permits feed to pass to the conveyor 14, but causes the feed to slide along the bin sides 35, thus polishing those sides, and minimizing the likelihood that feed will stagnate and spoil in the bin near the bin sides. Moreover, the disc 70 supports undelivered but dislodged feed, and prevents large amounts of dislodged falling feed from suddenly dropping upon the conveyor 14. In this way, the conveyor 14 is at least partly shielded from excessive wear and damage.

Mounted upon the feed support disc 70 is a wand 77 which here extends axially upwardly and rotationally rearwardly from the disc 70. The wand 77 does not, however, engage the walls 35 of the cone 16. As can be envisioned, the disc 70 is rotated by the motor 23 and shaft 20, and the want 77 is carried by the disc for equiangular rotation with the shaft 20 inside the sloping sides 35 of the bin cone 16. As the wand moves, it stirs and breaks up incipiently bridged feed immediately above the aperture 74, thus further promoting uniform feed delivery to the conveyor 14 and implementing the invention. As the feed is drawn toward the support disc 70 and aperture 74, the now-loosened feed is continuously stirred by the action of the wand 77 to inhibit any tendency for the feed to re-pack itself after its dislodgement and initial removal by the discs 38. The feed then falls through the aperture 74 in a relatively uniform flow.

Below the disc 70 and the gearbox 21, a shaft extension 80 can be provided, if desired, to mount agitators 81 and 82. When extremely difficult-to-handle feed or materials are being moved through the bin 16 and conveyor 14, these rotating agitators 81 and 82 further insure that feed located immediately above the conveyor 14 will not re-pack and bridge. Thus, the conveyor 14 is provided with unpacked, easy-to-move feed at a relatively uniform rate of flow.

The invention is claimed as follows:

1. Apparatus for positively delivering a steady flow of feed from a bin through a concially sided bin exhaust, comprising, in combination, first rotatable shaft means, second rotatable shaft means connected to the first shaft means so as to be driven by the first shaft means, and a plurality of separated polygonal disc members mounted on and extending from the second shaft means for engaging packed feed and dislodging the packed feed, whereby to permit the dislodged feed to fall downwardly through the bin exhaust, the second rotatable shaft means comprising an inner non-circular shaft element, and at least one outer non-circular shaft element adapted to slip over the inner shaft element and space apart adjacent polygonal disc members.

2. Apparatus according to claim 1 wherein said polygonal disc members define corners, said corners being bent out of the plane of the mediate portion of the disc member, whereby to increase the volume of space swept and the amount of feed dislodged.

3. Apparatus according to claim 1 wherein said polygonal discs are triangular in shape.

4. Apparatus according to claim 1 wherein said polygonal discs are angularly offset with respect to one another on said second shaft to provide even feed engagement action as the discs and shaft rotate.

5. Apparatus according to claim 1 further including distal disc means mounted at a distal end of said second shaft means.

6. Apparatus according to claim 5 wherein said distal disc means includes a non-abrasive saw-tooth-edged disc adapted for engagement with the bin side.

7. Apparatus according to claim 1 wherein said second rotatable shaft means is non-circular in cross-sectional shape.

8. Apparatus according to claim 1 further including distal disc means mounted at a distal end of said second shaft means, and mounting means for mounting the distal disc means to the second shaft means.

9. Apparatus according to claim 8 wherein said second rotatable shaft means is hollow, and wherein said mounting means comprises at least two locking elements having mating surfaces and being disposed at least partly inside the second rotatable shaft means, the locking means further including means for drawing the locking elements into engagement with one another and with the interior of the second rotatable shaft means.

10. Apparatus according to claim 1 including feed support means carried by the first shaft means below the second shaft means for rotation in the bin exhaust, the feed support means having a periphery spaced apart from the bin exhaust sides to define at least one annular aperture through which a flow of feed can pass.

11. Apparatus according to claim 10 wherein said bin feed support means comprises a disc.

12. Apparatus according to claim 11 wherein said feed support disc is provided with a polygonal periphery.

13. Apparatus according to claim 10 further including wand means carried by the feed support means.

14. Apparatus according to claim 13 wherein said wand means includes a wand member extending axially upwardly and rotationally rearwardly from said feed support means.

15. Apparatus according to claim 14 wherein said wand means is mounted on said feed support means substantially at the periphery thereof.

16. Apparatus according to claim 1 including a universal joint connector member interconnecting said first shaft means and said second shaft means for imparting rotational motion to said second shaft means.

17. Apparatus according to claim 1 further including shaft extension means extending substantially downwardly below said first shaft means, and agitator means mounted on the shaft extension means for rotation with the shaft extension means to inhibit re-packing of feed which has been dislodged and has fallen below said first shaft means.

18. Apparatus according to claim 16 wherein said rotatable shaft is non-circular in cross-sectional shape.

19. Apparatus according to claim 16 wherein said rotatable shaft means comprises an inner non-circular shaft element, and at least one outer non-circular shaft element adapted to slip over the inner shaft element and space apart said polygonal disc members.

20. Apparatus according to claim 16 further including distal disc means mounted at a distal end of said shaft means, and mounting means for mounting the distal disc means to the shaft means.

21. Apparatus according to claim 20 wherein said rotatable shaft is hollow, and wherein said locking means comprises at least two locking elements having mating surfaces and being disposed at least partly inside the rotatable shaft means, the locking means further including means for drawing the locking elements into engagement with one another and with the interior of the shaft.

22. Apparatus for positively delivering a steady flow of feed from a bin having a conically sided bin lower portion terminating at a planar bin exhaust port, the apparatus comprising a gear box drive and support structure located substantially in the plane of the bin exhaust port, first rotatable shaft means extending upwardly from the gear box drive and support structure out of the plane of the bin exhaust port into the conically sided bin interior, feed support disc means carried above the plane of the bin exhaust port on the first rotatable shaft means for rotation therewith, the feed support disc means having a periphery spaced apart from the conical bin side to define at least one annular aperture through which a flow of feed can pass, second rotatable shaft means extending from the first rotatable shaft means to a distal end adapted to be located adjacent the bin side, feed engagement means carried by the second rotatable shaft means for engaging and dislodging feed packed in the bin, universal joint means interconnecting the first rotatable shaft means and the second rotatable shaft means at a point above the feed support disc means to cause the second rotatable shaft means to be moved when the first rotatable shaft means is rotated, shaft extension means extending substantially vertically downwardly below the first shaft means and bin exhaust port from the gear box drive and support structure to a free distal end, and a rigid finger-like agitator wand means mounted on the shaft extension means free distal end and extending axially downwardly and radially outwardly for rotation with this shaft extension means to inhibit re-packing of feed which has been dislodged and has fallen below the first shaft means and gear box and support structure.

* * * * *